US005101582A

United States Patent [19]

Pozzobon

[11] Patent Number: 5,101,582

[45] Date of Patent: Apr. 7, 1992

[54] COMPOSITE SKI BOOT QUARTER

[75] Inventor: Alessandro Pozzobon, Padero di Ponzano Veneto, Italy

[73] Assignee: Nordica S.p.A., Montebelluna, Italy

[21] Appl. No.: 592,935

[22] Filed: Oct. 4, 1990

[30] Foreign Application Priority Data

Oct. 20, 1989 [IT] Italy ..... 82596 A/89

[51] Int. Cl.[5] ..... A43B 5/04

[52] U.S. Cl. ..... 36/117; 36/118

[58] Field of Search ..... 36/117, 118, 119, 120, 36/121

[56] References Cited

U.S. PATENT DOCUMENTS

| | | | |
|---|---|---|---|
| 3,803,730 | 4/1974 | Hanson et al. | 36/117 |
| 3,939,582 | 2/1976 | Garbuio | 36/117 |
| 4,184,273 | 1/1980 | Boyer et al. | 36/117 X |
| 4,280,286 | 7/1981 | Sartor | 36/118 |
| 4,510,703 | 4/1985 | Eiteljorg | 36/117 X |
| 4,587,747 | 5/1986 | Courvoisier et al. | 36/117 |

FOREIGN PATENT DOCUMENTS

| | | | |
|---|---|---|---|
| 15862 | 9/1980 | European Pat. Off. . | |
| 0071055 | 2/1983 | European Pat. Off. | 36/118 |
| 2310717 | 12/1976 | France . | |
| 1427640 | 3/1976 | United Kingdom . | |

*Primary Examiner*—Paul T. Sewell
*Assistant Examiner*—Beth Anne Cicconi
*Attorney, Agent, or Firm*—Guido Modiano; Albert Josif

[57] ABSTRACT

A ski boot quarter, the peculiarity whereof is that it is constituted by at least three separate elements which can be obtained separately and can subsequently be associated with one another. This solution allows to differentiate the materials which constitute the individual components of the structure using even non-plastic materials according to the specific region of the leg of the skier involved.

14 Claims, 2 Drawing Sheets

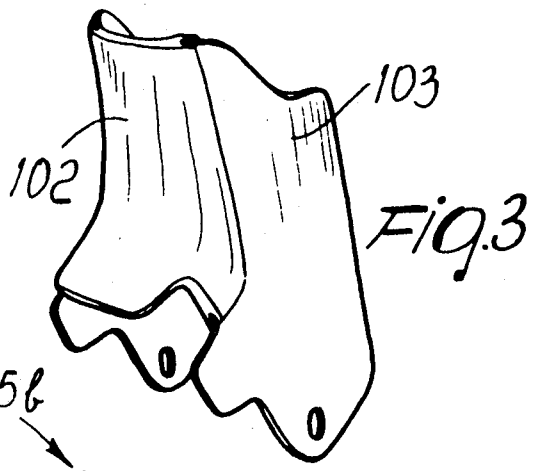
Fig. 3
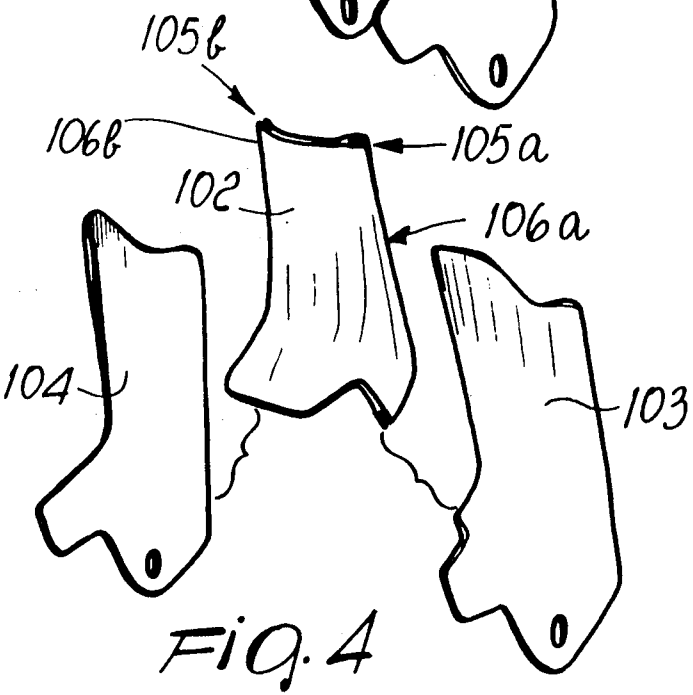
Fig. 4
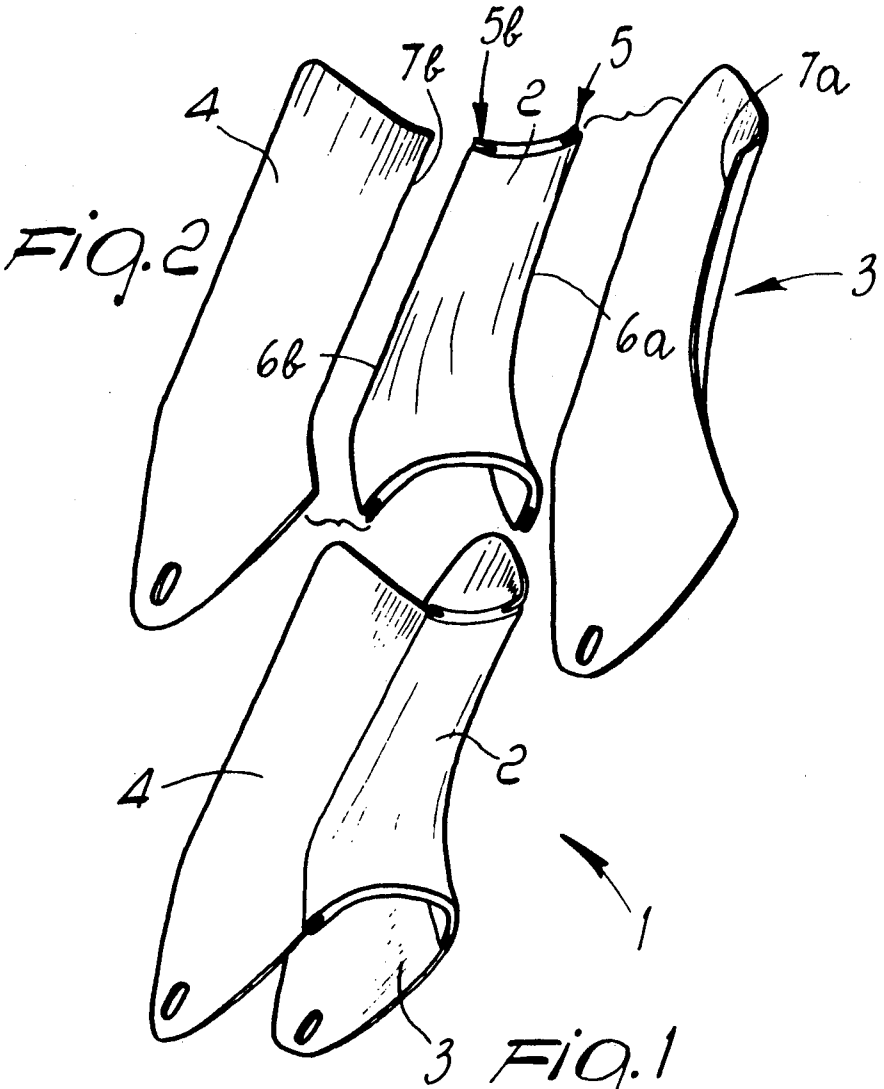
Fig. 2
Fig. 1

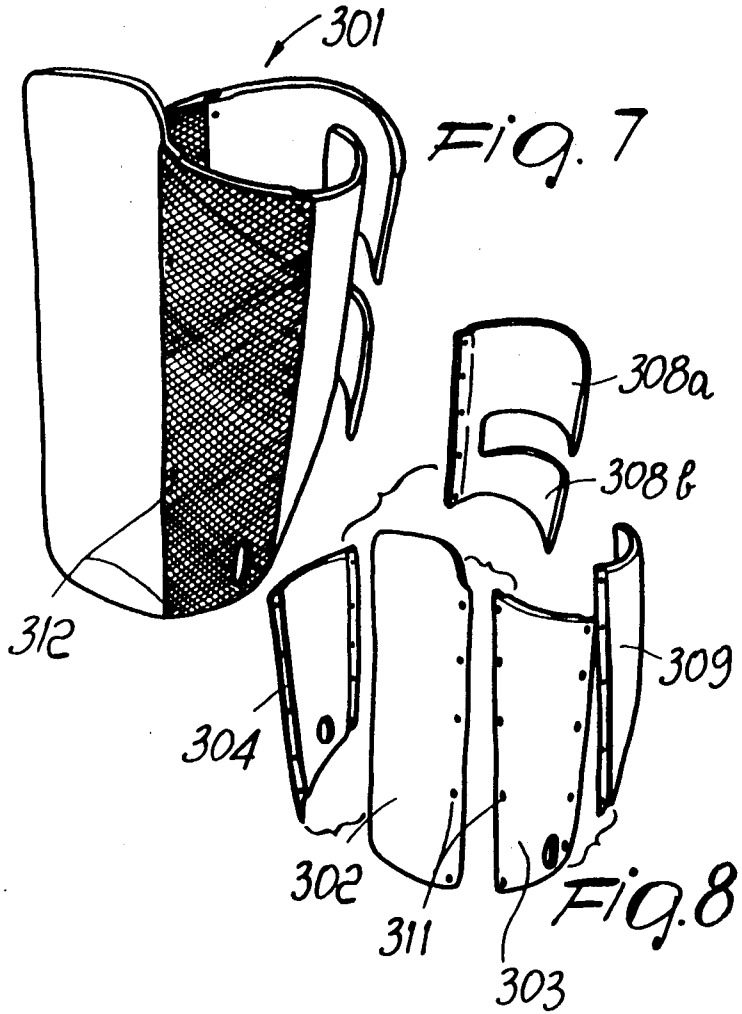
Fig. 7
Fig. 8
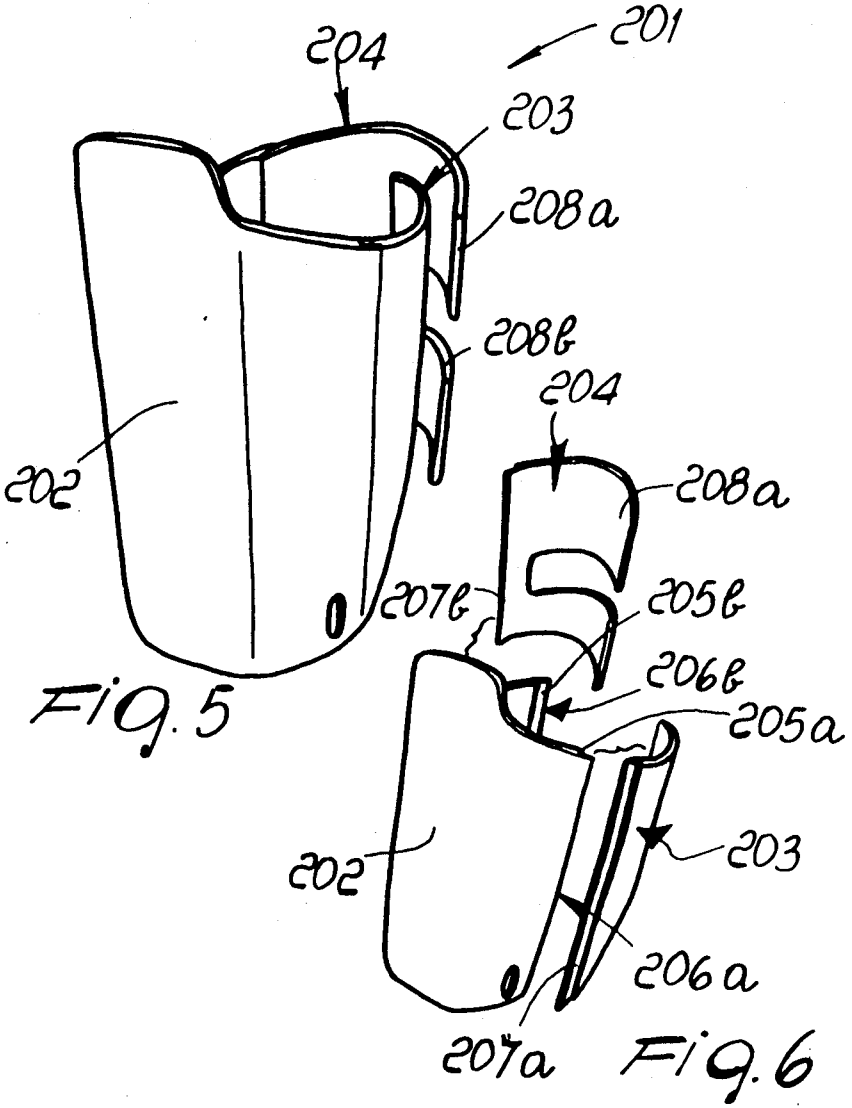
Fig. 5
Fig. 6

COMPOSITE SKI BOOT QUARTER

BACKGROUND OF THE INVENTION

The present invention relates to a ski boot quarter.

Currently, the quarters of the known ski boots, both of the rear-entry type and of the front-entry type, are made by injection-molding of thermoplastic material, said quarters being usually produced monolithically.

This manufacturing process entails some disadvantages, since the use of thermoplastic materials does not meet the various requirements of the skier while skiing, as the quarter or quarters must have at the same time a given flexibility for a comfortable support of the tibia and lateral rigidity for the optimum transmission of efforts to the ski.

As a partial solution to these disadvantages, a rear-entry ski boot is known wherein the front quarter is formed by two elements which are divided along a longitudinal axis and are composed of materials which have different rigidity.

Even this solution, however, has disadvantages, since the two elements are fastened at the longitudinal axis by means of an adapted slider, and therefore with an additional device, and it has furthermore been observed that during skiing the two elements undergo different deformations at the tibial support region.

This entails an uneven support of the tibia itself and a different yielding of the two elements during flexing, causing a troublesome and difficult control of the ski.

SUMMARY OF THE INVENTION

The aim of the present invention is therefore to eliminate the disadvantages described above in known types by providing a quarter which has flexibility and/or rigidity characteristics at the required points of the skier's leg.

Within the scope of the above described aim, another important object is to provide a quarter which allows to achieve an optimum and uniform support for the tibia.

Still another important object is to provide a quarter which has uniform yielding.

Another object is to provide a quarter which allows the optimum transmission of efforts to the ski.

Another object is to provide a quarter which is reliable and safe in use.

Not least object is to provide a quarter which has modest production costs and can be easily industrialized.

This aim, these objects and others which will become apparent hereinafter are achieved by a ski boot quarter, characterized in that it comprises at least three separate elements, said at least three separate elements being fastened together by means of fastening means.

BRIEF DESCRIPTION OF THE DRAWINGS

Further characteristics and advantages of the invention will become apparent from the description of some particular but not exclusive embodiments, illustrated only by way of non-limitative example in the accompanying drawings, wherein:

FIG. 1 is an isometric view of an assembled front quarter according to the invention;

FIG. 2 is an isometric exploded view of the quarter of the preceding figure, showing the individual elements which compose it;

FIG. 3 is a view, similar to that of FIG. 1, of an assembled quarter according to a second aspect of the invention;

FIG. 4 is an isometric exploded view, similar to that of FIG. 2, of the components of the quarter of FIG. 3;

FIG. 5 is a view, similar to that cf FIG. 1, of a quarter according to a third aspect of the invention;

FIG. 6 is an isometric exploded view of the quarter of FIG. 5;

FIG. 7 is a view, similar to that of FIG. 1, of a quarter according to a fourth aspect of the invention;

FIG. 8 is an isometric exploded view, showing the components of the quarter of FIG. 7.

DESCRIPTION OF THE PREFERRED EMBODIMENTS

With reference to the above figures, the reference numeral 1 indicates the quarter, particularly for rear-entry ski boots, which comprises a first element 2 which affects the front region of the tibia and embraces it approximately up to the foot instep.

The quarter 1 furthermore comprises a second element 3 and a third element 4 which affect the lateral regions of the leg of the skier, including therefore the tibia and the malleoli, and are associable at the first element 2.

The various elements are fastened together for example by welding, gluing, restraint jointing, riveting or by other known means.

In the particular embodiment illustrated in FIGS. 1 to 4, the means for the mutual assembly of the first, second and third elements are constituted by a pair of grooves 5*a* and 5*b* which are defined longitudinally at the lateral perimetric edges 6*a* and 6*b* of the first element 2.

Said pair of grooves 5*a* and 5*b* constitutes a seat in the restraint joint of the complementarily shaped perimetric edge 7*a* and 7*b* respectively of the second element 3 and of the third element 4.

For a more secure fastening the elements may also be glued together at the restraint joint.

By providing the quarter in three elements, it is possible to obtain diverse chromatic combinations and, most of all, a differentiation of the materials which compose the quarter structure itself, so that, for example, it is possible to have a first element 2, frontal with respect to the tibia, which is relatively yielding so as to have flexibility and a comfortable support for the tibia itself, whereas the lateral elements 2 and 3 can have a rigidity adapted to correctly transmit the efforts to the ski.

The individual elements can furthermore be obtained with a minimum curvature and therein more even with manufacturing processes other than the injection molding, thus adopting composite materials.

It has thus been observed that the invention has achieved the intended aim and objects, a quarter having been obtained which has characteristics of flexibility and/or rigidity at the required points of the skier's leg, providing an optimum and uniform support for the tibia and at the same time good lateral rigidity for the optimum transmission of efforts to the ski.

The individual components of the quarter can furthermore be produced according to processes differing from those of the injection of thermoplastic material and can be obtained for example by means of composite materials, the degree of rigidity whereof can be selected according to the specific requirements.

The quarter according to the invention is naturally susceptible to numerous modifications and variations, all of which are within the scope of the same inventive concept.

Thus, for example, as illustrated in FIGS. 3 and 4, the pair of grooves 105*a* and 105*b* defined at the perimetric edges 106*a* and 106*b* of the first element 102 can be obtained at an enlargement of the thickness defined at said perimetric edges, and the second element 103 and the third element 104 can also have various configurations according to the specific requirements, similarly to the first element 102.

FIGS. 5 and 6 illustrate a quarter for front-entry ski boots, indicated by the numeral 201, which is again constituted by a first element 202, by a second element 203 and by a third element 204.

The first element 202 can affect both the region behind the tibial region and, partially, the lateral regions thereof, and said structure can be made of a rigid material.

Longitudinal recesses 205*a* and 205*b* are defined at the lateral perimetric edges 206*a* and 206*b*, and a complementarily shaped end, defined at the perimetric edges 207*a* of the second element 203 and 207*b* of the third element 204, can be arranged thereat.

Advantageously, the second and third elements are made of a resilient material, and the element 204 has a pair of flaps 208*a* and 208*b* which partially embrace the outer lateral surface of the second element 203.

Adapted means, such as levers, suitable for further securing the elements to one another, may be applied at said flaps.

Said elements may also naturally be fastened together by means of adapted adhesives or by welding or riveting.

FIGS. 7 and 8 illustrate another embodiment of a quarter 301 for front-entry ski boots, comprising: a first element 302, which affects the rear region of the calf; a second element 303, which partially and laterally embraces the leg; a third element 304, which also, partially and laterally embraces the leg; a fourth element 309, which is associated with said second element ant partially and frontally embraces the leg; and a fifth element 310, which is associated with said third element 304 and has a pair of flaps 308*a* and 308*b* which partially embrace the outer surface of the fourth element 309.

Advantageously, all of said first, second, third, fourth and fifth elements can be fastened together by means of an adapted riveting or by screwing or gluing or welding, the second and the third elements being advantageously made, for example, of composite materials with high rigidity.

The fourth and fifth element can instead be made of a material which has a certain resiliency so as to increase the comfort of the skier.

In the particular embodiment, the reference numerals 311 indicate holes which are defined at the perimetric edges of the first, second, third, fourth and fifth elements, and constitute seats for adapted mutual locking rivets 312.

The materials, as well as the dimensions, which constitute the individual components of the structure may naturally also be the most appropriate according to the specific requirements.

I claim:

1. Composite ski boot quarter having an upper edge, a lower edge, and a longitudinal extension, said longitudinal extension extending from said upper edge to said lower edge, said composite ski boot quarter comprising a front element for supporting a user's tibial leg portion, and two side elements for supporting a user's side leg portions, said front element having a pair of lateral side edges which extend substantially along said longitudinal extension from said upper edge to said lower edge, each one of said two side elements having a respective perimetric edge which extends substantially along said longitudinal extension from said upper edge to said lower edge, said each one of said two side elements being connected to said front element to thereby form said composite ski boot quarter, and specifically said perimetric edge of said each one of said two side elements being connected to a respective one of said pair of lateral side edges of said front element.

2. The composite ski boot quarter according to claim 1, wherein grooves are provided at said pair of lateral side edges of said front element, said perimetric edge of said each one of said two side elements being fitted in said grooves of said front element to thereby mutually connect said front element and said two side elements in a restraint jointing manner, said composite ski boot quarter being a front ski boot quarter useful in a rear entry ski boot.

3. The composite ski boot quarter according to claim 2, wherein said front element has an increased thickness at said grooves.

4. The composite ski boot quarter according to claim 1, wherein respective longitudinal recesses are provided at said pair of lateral side edges of said front element and said perimetric edges of said two side elements, said front element and said two side elements being connected together at said longitudinal recesses by means of welding, gluing or riveting.

5. The composite ski boot quarter according to claim 1, wherein said front element comprises a first front element and a second front element, said second front element being provided with flaps for at least partially and temporarily embracing an outer lateral surface of said first front element, said composite ski boot quarter further comprising a region extending between said two side elements for supporting a user's rear leg portion, thereby said ski boot quarter being useful in a front entry ski boot.

6. The composite ski boot quarter according to claim 5, wherein said region for supporting a user's rear leg potion is a separate element from said two side elements, said two side elements and said separate element being connected at seams which extend substantially along said longitudinal extension from said upper edge to said lower edge.

7. Composite ski boot quarter having an upper edge, a lower edge, and a longitudinal extension, said longitudinal extension extending from said upper edge to said lower edge, said composite ski boot quarter comprising a front element for supporting a user's tibial leg portion, and two side elements for supporting a user's side leg portions, said front element having a pair of lateral side edges which extend substantially along said longitudinal extension from said upper edge to said lower edge, each one of said two side elements having a respective perimetric edge which extends substantially along said longitudinal extension from said upper edge to said lower edge, said each one of said two side elements being connected to said front element to thereby form said composite ski boot quarter, and specifically said perimetric edge of said each one of said two side elements being connected to a respective one of said pair of lateral side edges of said front element, said two side elements being made of relatively rigid material with respect to said front element which is made of slightly yielding material thereby to provide comfortable support of a user's front leg portion and simultaneously responsive transmission of forces at a user's side leg portions.

8. The composite ski boot quarter according to claim 7, wherein grooves are provided at said pair of lateral side edges of said front element, said perimetric edge of said each one of said two side elements being fitted in said grooves of said front element to thereby mutually connect said front element and said two side elements in a restraint jointing manner, said composite ski boot quarter being a front ski boot quarter useful in a rear entry ski boot.

9. The composite ski boot quarter according to claim 8, wherein said front element has an increased thickness at said grooves.

10. The composite ski boot quarter according to claim 7, wherein respective longtiduian recesses are provided at said pair of lateral side edges of said front element and said perimetric edges of said two side elements, said front element and said two side elements being connected together at said longitudinal recesses by means of welding, gluing or riveting,

11. The composite ski boot quarter according to claim 7, wherein said front element comprises a first front element and a second front element, said second front element being provided with flaps for at least partially and temporarily embracing an outer lateral surface of said first front element, said composite ski boot quarter further comprising a region extending between said two side elements for supporting a user's rear leg portion, thereby said ski boot quarter being useful in a front entry ski boot.

12. The composite ski boot quarter according to claim 11, wherein said region for supporting a user's rear leg portion is a separate element from said two side elements, said two side elements and said separate element being connected at seams which extend substantially along said longitudinal extension from said upper edge to said lower edge.

13. Composite ski boot quarter having an upper edge, a lower edge, and a longitudinal extension, said longitudinal extension extending from said upper edge to said lower edge, said composite ski boot quarter comprising three distinct separately made elements which are mutually fixedly connected to form said composite ski boot quarter, said three elements being constituted by a first element for supporting a user's front leg portion or a user's rear leg portion, and a second element and a third element each for supporting a respective one of a user's side leg portions, said first element having a first lateral side edge and a second lateral side edge which both extend substantially along said longitudinal extension from said upper edge to said lower edge, said second element having a second element perimetric edge which extends substantially along said longitudinal extension from said upper edge to said lower edge, said third element having a third element perimetric edge which extends substantially along said longitudinal extension from said upper edge to said lower edge, said second perimetric edge of said second element being connected at said first lateral side edge of said first element thereby said second element being fixedly connected to said first element, said third perimetric edge of said third element being connected at said second lateral side edge of said first element thereby said third element being fixedly connected to said first element.

14. The composite ski boot quarter of claim 13, wherein said first element is made of a material having a first degree of elasticity, said second and said third elements being made of material having a degree of elasticity which is more rigid than said first degree of elasticity.

* * * * *